US010486941B2

(12) United States Patent
Finschi et al.

(10) Patent No.: US 10,486,941 B2
(45) Date of Patent: Nov. 26, 2019

(54) LIFT SYSTEM HAVING INDIVIDUALLY DRIVEN CARS AND A CLOSED TRACK

(71) Applicant: Inventio AG, Hergiswil (CH)

(72) Inventors: Lukas Finschi, Ebicon (CH); Florian Troesch, Erlenbach (CH); Paul Friedli, Remetschwil (CH); Kilian Schuster, Emmenbrücke (CH); Jonas Vonaesch, Lucerne (CH)

(73) Assignee: Inventio AG, Hergiswil (CH)

( * ) Notice: Subject to any disclaimer, the term of this patent is extended or adjusted under 35 U.S.C. 154(b) by 278 days.

(21) Appl. No.: 15/515,912

(22) PCT Filed: Sep. 29, 2015

(86) PCT No.: PCT/EP2015/072483

§ 371 (c)(1),
(2) Date: Mar. 30, 2017

(87) PCT Pub. No.: WO2016/050803

PCT Pub. Date: Apr. 7, 2016

(65) Prior Publication Data

US 2017/0305718 A1 Oct. 26, 2017

(30) Foreign Application Priority Data

Sep. 30, 2014 (EP) ..... 14187115

(51) Int. Cl.
*B66B 9/02* (2006.01)
*B66B 1/24* (2006.01)
(Continued)

(52) U.S. Cl.
CPC ..... *B66B 9/022* (2013.01); *B66B 1/2433* (2013.01); *B66B 1/3461* (2013.01); *B66B 9/003* (2013.01); *B66B 9/10* (2013.01)

(58) Field of Classification Search
CPC ..... B66B 9/022; B66B 9/0003; B66B 9/10; B66B 1/2433
See application file for complete search history.

(56) References Cited

U.S. PATENT DOCUMENTS 561,223 A * 6/1896 Hamilton ..... B66B 9/003 198/800
2,612,238 A * 9/1952 Angelicola ..... B66B 9/10 187/249

(Continued)

FOREIGN PATENT DOCUMENTS

JP H05-139659 A 6/1993
JP 2004-269193 A 9/2004

(Continued)

*Primary Examiner* — Diem M Tran
(74) *Attorney, Agent, or Firm* — BakerHostetler

(57) ABSTRACT

A lift system for moving a car along a track in a guided manner. The lift system having a guide rail system, a car and a drive unit arranged on the car. The guide rail system forms a closed track along which the car can be moved between floors when in operation. The drive unit has a motor, a gear wheel system connected to the motor by a shaft and a guide disk. The guide rail system has a pinion system and guide edges spaced apart from one another, which cooperate with the guide disk. When in operation, the motor drives the gear wheel system and the gear wheel system acts on the pinion system in order to move the car along the track in a guided manner.

11 Claims, 16 Drawing Sheets

(51) Int. Cl.

| | |
|---|---|
| ***B66B 9/10*** | (2006.01) |
| ***B66B 1/34*** | (2006.01) |
| ***B66B 9/00*** | (2006.01) |

(56) References Cited

U.S. PATENT DOCUMENTS

| | | | | |
|---|---|---|---|---|
| 3,658,155 | A | 4/1972 | Salter | |
| 10,202,259 | B2 * | 2/2019 | Scomparin | B66B 9/003 |

FOREIGN PATENT DOCUMENTS

| | | | | |
|---|---|---|---|---|
| JP | 2011-006227 | A | 1/2011 | |
| WO | WO-9938790 | A2 * | 8/1999 | B66B 7/022 |
| WO | 2009/072138 | A1 | 6/2009 | |
| WO | 2009/125253 | A1 | 10/2009 | |
| WO | WO-2009125253 | A1 * | 10/2009 | B66B 9/00 |
| WO | 2012/038760 | A2 | 3/2012 | |

* cited by examiner

LIFT SYSTEM HAVING INDIVIDUALLY DRIVEN CARS AND A CLOSED TRACK

CROSS-REFERENCE TO RELATED APPLICATION

This application is the national phase application under 35 U.S.C. § 371 claiming the benefit of priority based on International Patent Application Ser. No. PCT/EP2015/072483, filed on Sep. 29, 2015, which claims the benefit of priority based on European Patent Application Ser. No. 14187115.2, filed on Sep. 30, 2014. The contents of each of these applications are herein incorporated by reference.

FIELD OF THE INVENTION

The technology described here relates in general to lift systems having a plurality of cars in a shaft. The technology relates in particular to those lift systems in which the cars can be moved individually on a closed rail track. Various exemplary embodiments of the technology relate in particular to configurations of the rail track and a drive unit.

BACKGROUND

In known lift systems (e.g. traction lifts or hydraulic lifts), a car moves along a linear track in order to transport a passenger from an entry floor to an exit floor. In an exemplary traction lift, the car is suspended on a suspension means which connects the car to a counterweight and is driven by a drive motor. Guide rails installed in a lift shaft form the linear track and extend between the shaft pit (lower shaft region) and a shaft head (upper shaft region). The drive motor is in this case arranged in the shaft head or a separate machine room.

An alternative concept for a lift system is described in WO 2009/072138. This lift system has a rail track consisting of two vertical subsections and two horizontal subsections (an upper part and a lower one). In one configuration of this lift system a plurality of cars can be moved on the rail track; in this case, each car is driven individually by a motor. The upward and downward movements of a car are made with the aid of a drive gear wheel and a brake. In the upper subsection a car can be displaced by a hydraulic or pneumatic cylinder horizontally from a vertical subsection to the other vertical subsection.

JP 2004269193 describes a lift system having a track on which a plurality of self-driven cars can be moved. In order to guide a car from one vertical subsection to another vertical subsection, points are provided which insert horizontal subsections. The points are in this case adjusted by a gear train. Respectively one roller drive is provided on the upper part of a car and on the lower part of the car, the rollers of which apply force to a guide rail in order to move the car.

The said solutions are based on different approaches, for example, with regard to drive and direction reversal, for example in the upper rail area. In this respect WO 2009/072138 does not disclose any specific implementation details. The direction reversal by the gear-wheel driven points system of JP 2004269193 appears relatively complex and therefore also liable to breakdown. In addition, the insertion of the horizontal subsections takes place relatively slowly. There is therefore a need for an improved technology in relation to drive and direction reversal.

SUMMARY OF THE INVENTION

One aspect of such an improved technology relates to a lift system having a guide rail system, a car and a drive unit arranged on the car. The guide rail system forms a closed track along which the car can be moved between floors when in operation. The drive unit has a motor, a gear wheel system coupled to the motor by means of a shaft and a guide disk, wherein the motor drives the gear wheel system when in operation. The guide rail system has a pinion system and guide edges spaced apart from one another, which cooperate with the guide disk. The gear wheel system acts on the pinion system when in operation in order to move the car along the track in a guided manner.

According to this technology, the car is driven by the drive unit arranged on the car. Such a self-driven car can move relatively freely on the closed track without being restricted to vertical up/down movements by supporting cables, supporting belts or hydraulic cylinders. The free mobility enables inter alia travel around bends and circulating travel with or without direction reversal. However, the technology is so flexible here that if required (e.g. when there are few requests for travel (e.g. at night)), only vertical up/down movements can be executed.

The technology additionally makes it possible that a plurality of cars can be provided which can be moved independently of one another on the closed track. This increases the capacity of the lift system. An increased capacity can be desired, for example, in the morning, in the evening and/or at lunchtime in an office building when many people wish to travel from one floor to another floor. The technology also offers a high degree of flexibility here: outside these times when there are relatively few requests for travel, cars which are not required for such a volume of traffic can be temporarily taken out of operation ("parked").

In one exemplary embodiment a central control unit and a fixed number of floor terminals are provided and each car has a local control unit. This central control unit is connected communicatively to the floor terminal and the local control units. The central control unit thus knows the status (e.g. movement parameters including position data as exemplary status parameters) of a car at each time point. For example, if a destination call is received, the central control unit uses the status information of all the cars in order to select a suitable car for this destination call. The car thus selected then receives a corresponding control command from the central control unit.

The communicative connection between the central control unit and the local control units is made in one exemplary embodiment via a radio network, e.g. a WLAN. This simplifies in a known manner the installation of a communication network required for communication. The floor terminals can in this case either communicate with the central control unit via the radio network or a wired communication network.

In one exemplary embodiment, the pinion system comprises a plurality of first pins arranged in a first row and spaced apart by intermediate spaces and a plurality of second pins arranged in a second row and spaced apart by intermediate spaces. The first row and the second row are arranged along a common line on a first guide portion of the guide system. The pins are visible along the guide system and therefore can be checked, for example, by a service engineer; the engineer can replace them if necessary without larger parts of the guide system needing to be exchanged.

According to one exemplary embodiment, when such pins are used, the first pins on a first side of the first guide portion point in a first direction and the second pins on a second side of the first guide portion point in a second direction, where the first direction is opposite the second direction.

In one exemplary embodiment the gear wheel system has a first gear wheel disk and a second gear wheel disk spaced apart from this, which are arranged on the shaft. The guide disk is arranged between the first and the second gear wheel disk on the shaft. The guide disk, for example, has a guide groove into which the guide edges engage. The functions of guidance and drive are therefore close to one another at the drive unit. This has the advantage that dimensional tolerances, e.g. relating to the distance between guide edges and guide groove need only be maintained over small distances; this is simpler for constricted space than for large distances.

According to one exemplary embodiment, the gear wheel disks are twisted with respect to one another, for example by half a tooth pitch. It is thereby achieved that at least one gear wheel always engages in the pinion system and continuously applies a force to the pinion system, where however a continuous guidance is accomplished, regardless of whether the car is moved horizontally or vertically.

In one exemplary embodiment, a conductor track is provided on the guide rail system with which the drive unit is in electrical contact in order to supply the drive unit with electrical energy. This has the advantage that a central conductor track supplies all the cars and drive units with electrical energy without suspension cables for example being required for this.

In one exemplary embodiment the guide rail system has a guide element which extends along a vertical subsection of the guide rail system. The guide element engages in a receptacle coupled to the car. The receptacle can be provided on the car configured as a guide groove. The receptacle can also be provided on a guide shoe configured as a guide groove.

The guide shoe is arranged non-rotatably about the shaft. On one side facing the gear wheel system and the pinion system, the guide shoe according to one exemplary embodiment has parts which define travel paths. A guide profile which can be guided in one of the travel paths is affixed on the pinion system. This has the result that the drive unit is guided as long as possible on the guide rail system.

Various aspects of the improved technology are explained in detail hereinafter with reference to exemplary embodiments in conjunction with the figures. In the figures the same elements have the same reference numbers. In the figures:

DETAILED DESCRIPTION OF CERTAIN EMBODIMENTS

Figure 1:
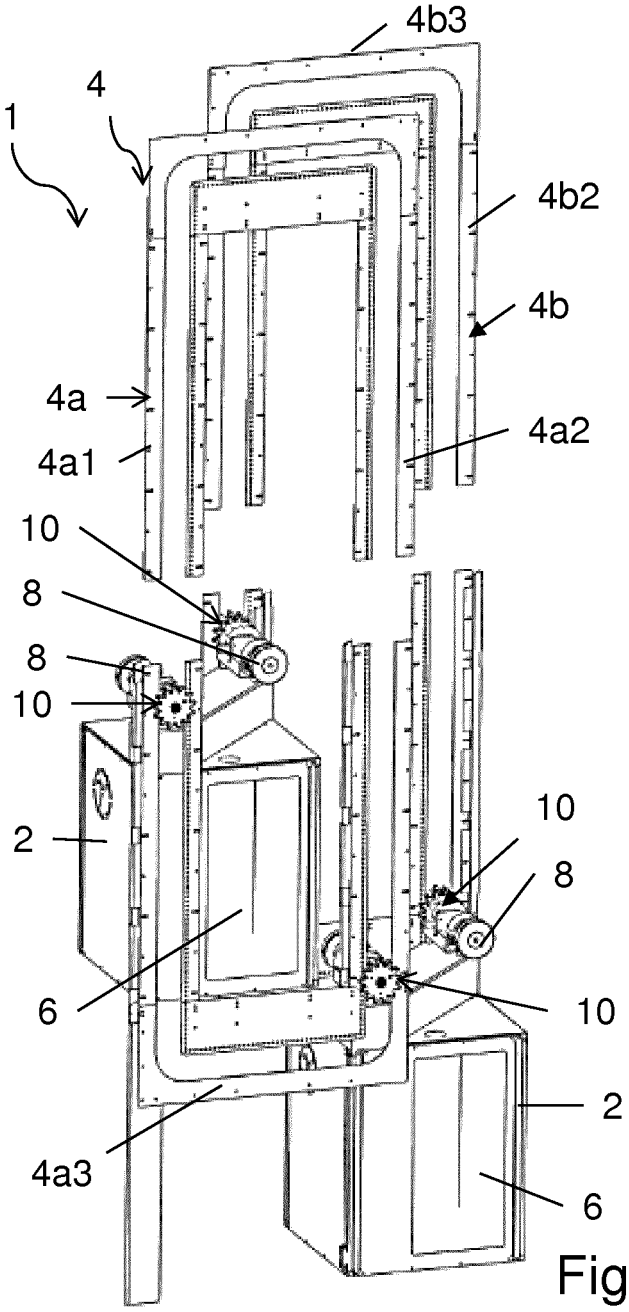
FIG. 1 shows a schematic perspective view of an exemplary embodiment of a lift system with a guide system for a plurality of self-driven cars in first positions.
Figure 2:
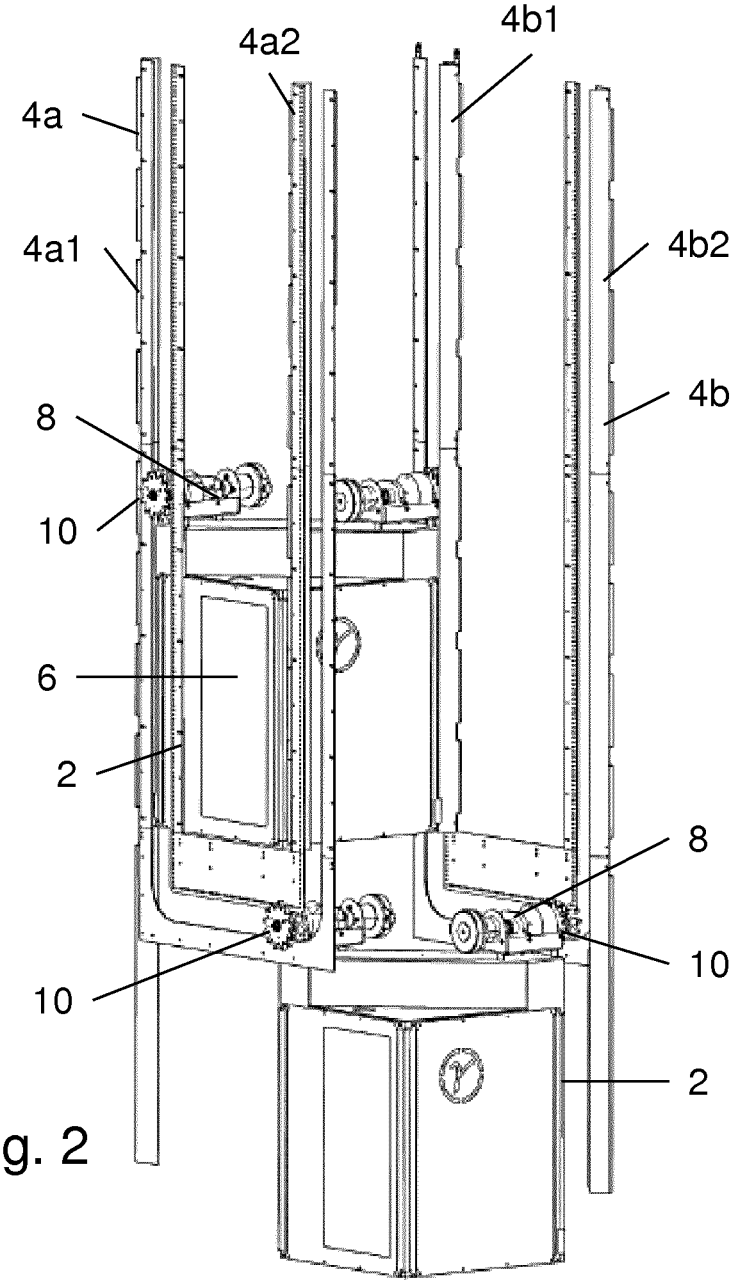
FIG. 2 shows an enlarged illustration of a lower region of the lift system from FIG. 1, wherein the cars are located in second positions.

FIG. 1 shows a perspective and schematic view of an exemplary embodiment of a lift system 1 with a guide system 4 for a plurality of self-driven cars 2 in first positions. FIG. 2 shows an enlarged illustration of a lower region of the lift system 1 from FIG. 1 from a different perspective, where the cars 2 are located in second positions. In both positions the lift cars 2 are located in the lower region of the guide system 4; in FIG. 1 both cars 2 are located on vertical sections of the guide system 4 and in FIG. 2 one of the cars 2 is located on a horizontal section of the guide system 4 whilst the other car 2 is located on a vertical section.

Such a lift system 1 is usually installed in a shaft inside a multi-storey building. Such a shaft can be variously configured, for example, as a shaft with four walls or as a shaft with less than four walls, for example, as a so-called panorama lift. For better clarity FIG. 1 and FIG. 2 do not show either a shaft or fixing structures, shaft doors or individual floors. However, the person skilled in the art identifies that the guide system 4 is fixed in the shaft by various fixing structures. Parts of these fixing structures are shown, for example, in FIG. 4. The person skilled in the art also identifies that usually on each floor a shaft door shuts off the shaft in order to prevent access when no car 2 is located on the floor. Only when there is a request to enter or exit on a floor and the car 2 is located at the floor, does the shaft door open together with a car door. No car doors are shown in FIG. 1 and FIG. 2, only openings 6 in the cars 2. The car door which closes or opens the opening 6 is located in the area of an opening 6.

The guide system 4 consists of a door-side (or front) subsystem 4*a* and a (when viewed from the floor) rear-side (or rear) sub-system 4*b*. Each sub-system 4*a*, 4*b* has vertical sub-sections 4*a*1, 4*a*2, 4*b*1, 4*b* and horizontal sub-sections 4*a*3, 4*b*3 in the upper and lower area. The horizontal sub-sections 4*a*3, 4*b*3 connect the vertical sub-sections 4*a*1, 4*a*2, 4*b*1, 4*b*2 to one another; a closed rail track for the cars 2 is formed by connecting the sub-sections.

As indicated in FIG. 1 and FIG. 2, the sub-systems 4*a*, 4*b* are laterally offset with respect to one another. In FIG. 1 the left car 2 travels along the vertical sub-sections 4*a*1, 4*b*1 and the right car 2 travels along the vertical sub-section 4*a*2, 4*b*2. The vertical sub-sections 4*a*1, 4*b*1; 4*a*2, 4*b*2 are each spaced apart laterally from one another. In one exemplary embodiment this distance approximately corresponds to a door-side width of the car 2 and in this free space allows entry to or exit from the car 2 through the opening 6 on a floor.

Each car 2 is self-driven, i.e. a drive unit 8 is provided on the car 2 which—for example controlled by a local and/or central lift controller (see on this matter description of FIG. 18)—applies a force to the guide system 4 in order to move the car 2. In one exemplary embodiment the drive unit 8 is arranged on a roof of the car 2. In the exemplary embodiment shown in FIG. 1 and FIG. 2, two drive units 8 are arranged on the roof of the car 2, where a door-side (front) drive unit 8 applies force to the door-side sub-system 4*a* and a rear-side (rear) drive unit 8 applies force to the rear-side sub-system 4*b*. The drive units 8 are arranged diagonally in relation to the rectangular surface of the roof of the car 2, in FIG. 1 and FIG. 1, front left and rear right in each case.

In one exemplary embodiment, the two drive units 8 are actuated by the inverters assigned to them so that they are operated synchronously to one another. This can be achieved, for example, whereby the two inverters are mutually synchronized in operation with respect to their respective travel curves.

In order to be able to exert said force on the guide system 4, there is a tight fit between the guide system 4 and a drive unit 8. To this end, the guide system 4 has a rack and pinion system and each drive unit 8 has a gear wheel system 10 which engages in the rack and pinion system. The combination of the rack and pinion system and the gear wheel system 10 forms a rack and pinion gearing. Each drive unit 8 additionally has inter alia a motor, a transmission and a brake. Details of the rack and pinion system are described, for example, in connection with FIG. 6 and details of the drive unit 8 are described, for example in connection with FIG. 8-FIG. 10.

Figure 3:
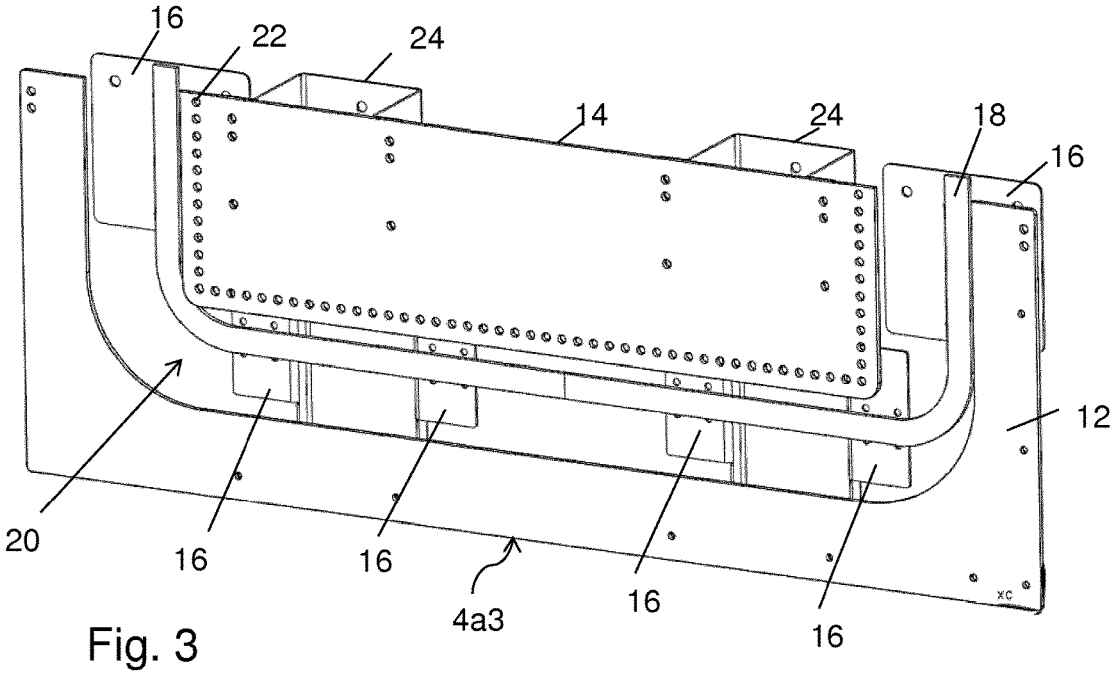
FIG. 3 shows a schematically depicted exemplary embodiment of a part of the guide system from the lower region of the lift system shown in FIG. 2.

FIG. 3 shows a schematic exemplary embodiment of a horizontal sub-section 4*a*3 of the guide system 4 from the lower region of the lift system 1 shown in FIG. 1. A horizontal sub-section from the upper region of the lift system is configured accordingly; this also applies to corresponding rear-side sub-sections. The sub-section 4*a*3 shown has a guide portion 12 and a guide portion 14 which are fabricated from steel sheet and as flat profiles and lie in a (common) plane (in the installed state they lie in a vertical plane). The guide parts 12, 14 are spaced apart from one another so that a free space exists between these parts 12, 14. This free space is hereinafter designated as track 20 because parts of the drive unit 8 travel along there. This track 20 extends in the plane of the guide parts 12, 14 along the door-side sub-system 4*a* and is a closed track, i.e. a track without beginning or end which can be travelled around arbitrarily frequently without, for example, needing to pass a transition point or leaving guides; this is similar to the principle of a paternoster lift. A corresponding track is provided in the rear-side sub-system 4*b*. In FIG. 3 the guide portion 14 is fastened to a supporting structure 24. The guide portion 12 is also fastened to a supporting structure 24 which however is not shown in FIG. 3.

In the exemplary embodiment shown in FIG. 3, a conductor track 18 is shown, which is held by fastening elements 16 in a plane parallel to the plane of the guide portions 12, 14. The fastening elements 16 are, for example, made of electrically insulating material (e.g. plastic) in order to insulate the conductor track 18 electrically from conducting parts of the guide system 4. The conductor track 18 runs as a closed track parallel to the track 20. During operating the drive unit 8 contacts the conductor track 18 and is supplied with electrical energy via the conductor track 18, for example the sub-system 4*a*. The circuit is closed by the drive unit 8 and the conductor track 18 of the sub-system 4*b*. The spacing of the said planes is dependent on the size of the drive unit 8 and is selected so that a contact element of the drive unit 8 is continuously in contact with the conductor track 18 during operation. In one configuration the conductor track 18 is a flat profile. In another exemplary embodiment the conductor track 18 is a groove profile with a longitudinal groove in which a sliding contact can be inserted. In another exemplary embodiment, the transfer of electrical energy can also be made in a contactless manner by induction.

In the exemplary embodiment shown the guide portion 14 has a plurality of spaced-apart recesses 22 arranged adjacent to one another. The recesses 22 are located in the edge regions of the guide portion 14. In one configuration these recesses 22 are holes and receive pins, which are part of the rack and pinion system and in which the gear wheel system 10 of the drive unit 8 engages. A guide portion 14 with such a pin is described in connection with FIG. 6.

Figure 4:
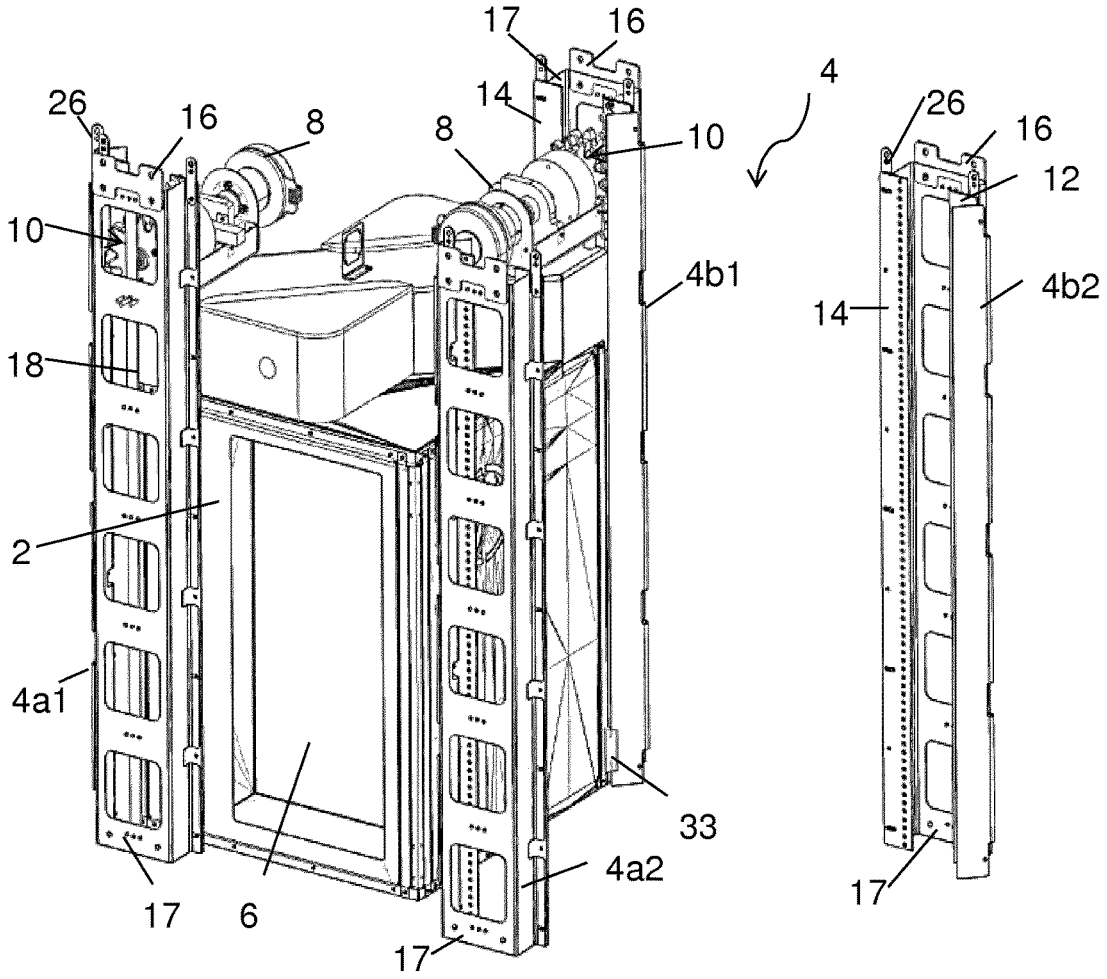
FIG. 4 shows a detailed illustration of the guide system with car and drive unit arranged therein.

FIG. 4 shows an illustration of the guide system 4 with a car 2 arranged therein and two drive units 8 on the roof of the car 2. In this case, parts of the vertical sub-sections 4*a*1, 4*b*1; 4*a*2, 4*b*2 of the guide system 4 are shown. The car 2 shown could be located, for example, on a floor not shown, where the opening 6 points towards the floor. In addition, FIG. 4 shows fastening structures by means of which the guide system 4 is fastened in the shaft. This includes fastening rails 17 of which FIG. 4 shows one per sub-section 4*a*1, 4*a*2, 4*b*1, 4*b*2. Depending on the height of the building—a plurality of fastening rails 17 are interconnected per sub-section 4*a*1, 4*a*2, 4*b*1, 4*b*2, for example, by fastening elements 26 and form the track 20 in conjunction with horizontal sub-sections. The fastening elements 16 and the conductor tracks 18 are also fastened to the fastening rails 17.

FIG. 4 illustrates that the car 2 is guided by the vertical sub-sections 4*a*1, 4*b*1 and each gear wheel system 10 of a drive unit 8 engages in the rack and pinion system provided on the respective sub-section 4*a*1, 4*b*1. Another car 2 can travel along the vertical subsections 4*a*2, 4*b*2 shown in FIG. 4. In this case, the drive units 8 of this (additional) car 2 engages in the rack and pinion systems of the sub-sections 4*a*2, 4*b*2.

Figure 5:
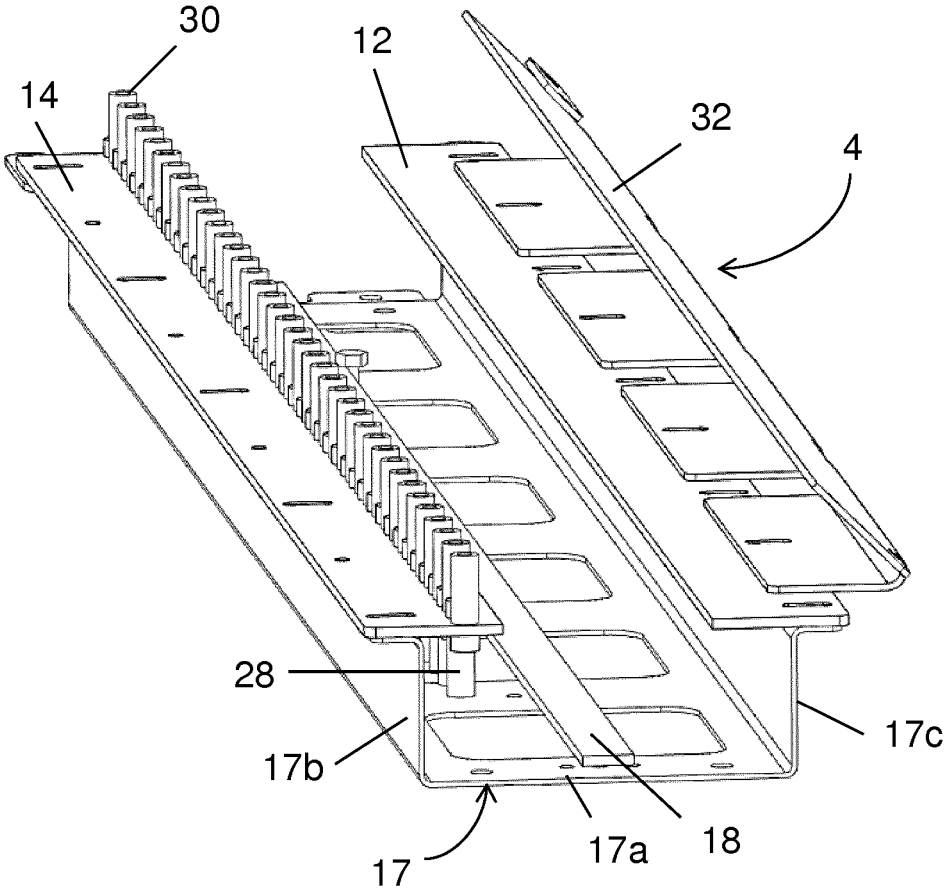
FIG. 5 shows a schematically depicted exemplary embodiment of the guide system in perspective view.

FIG. 5 shows a schematic exemplary embodiment of the guide system 4 in perspective view. The size information and distance information mentioned hereinafter are exemplary; a person skilled in the art identifies that this information can vary according to the lift system 1 (for example, in relation to car load). Shown is a part of the fastening rail 17 which has a U-shaped cross-sectional profile with a wall portion 17*a* and two side portions 17*b*, 17*c*. A conductor track 18 is fastened to the wall portion 17*a*, for example inter alia by means of the fastening elements 16 shown in FIG. 3. Each side portion 17*b*, 17*c* has a flange at its free end on which one of the guide portions 12, 14 is fastened. The guide portion 14 is fastened to the side portion 17*b* and the guide portion 12 is fastened to the side portion 17*c*. The guide portions 12, 14 are thus fastened so that they project laterally into a space 19 (see FIG. 6) formed by the side portions 17*b*, 17*c* and the wall portion 17*a* and delimit these. A guide element 32 which extends along the guide portion 12 is fastened to the guide portion 12. In the exemplary embodiment shown the guide element 32 is an angular profile, where the legs of the angular profile enclose an angle of about 45°. Depending on the configuration, the legs can also enclose a different angle. During operation a leg of the angular profile engages in the guide groove 33 (see FIG. 4 and FIG. 7) on the car 2, in order to stabilize the car 2 during the travel. In another exemplary embodiment the guidance can be accomplished by means of one or more round guides in which a guide rod is embraced by a guide shoe.

The rack and pinion system comprising the pins 28, 30 is arranged on the guide portion 14. In the exemplary embodiment of the rack and pinion system shown, a plurality of pins 30 spaced apart by intermediate spaces is arranged in a row, where ends of the pins 30 are fastened or placed in the recesses 22 (FIG. 3) of the guide portion 14 and point away from the wall portion 17*a*. The pins 28 are also arranged in the same row and spaced apart by these intermediate spaces, where the ends thereof are also fastened or placed in the recesses 22 of the guide portion 14 but point towards the wall portion 17*a*. In relation to the space 19 (and in relation to the function thereof, namely the interaction with the gear wheel system 10), the pins 28 point into the space 19 or are located for the most part in the space 19 and the pins 30 are for the most part outside the space 19. In one exemplary embodiment the pins 28, 30 are screwed into the recesses 22.

It can be seen in FIG. 5 that the row of pins 30 is arranged offset to the row of pins 28. That is, if the recesses 22 in FIG. 3 are viewed, the pins 28, 30 alternate along the row of recesses 22. The distances between the individual pins 28, 30 in one exemplary embodiment are about 30 mm to about 50 mm, for example about 40 mm. For example, the distance from a pin 28 to a pin 28 is then about 60 mm to about 100 mm, for example, about 80 mm; this corresponds to the pin spacing for the gear wheel 10*b*.

In another exemplary embodiment, the pins 28, 30 are not arranged alternately in the recesses 22. In this variant only every other recess 22 is used. Then "bilateral" pins are installed in these recesses 22, for example, two pins 28, 30 are connected through the recess 22 by a setscrew. In this arrangement the gear wheels 10*a*, 10*b* are not mounted in an offset manner.

Figure 6:
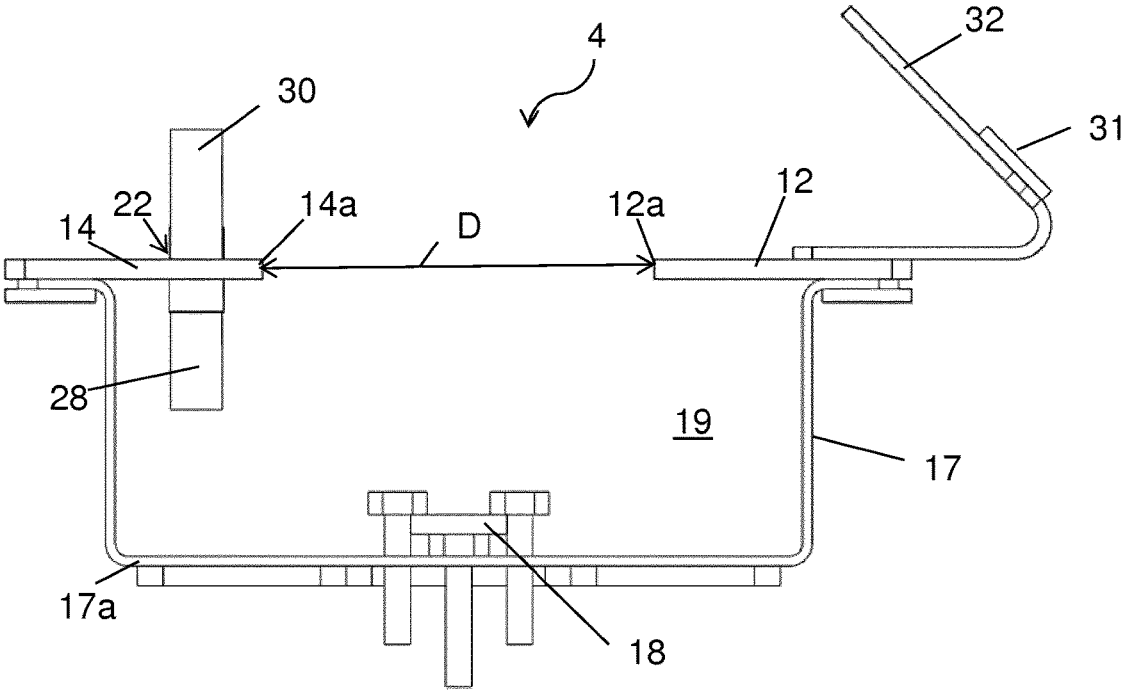
FIG. 6 shows a cross-section through the exemplary embodiment of the guide system shown in FIG. 5.

FIG. 6 shows a cross-section through the exemplary embodiment shown in FIG. 5. The guide portions 12, 14 are arranged spaced apart from one another in one plane, which is substantially parallel to a plane of the wall portion 17*a*. Between a guide edge 12*a* of the guide portion 12 and a guide edge 14*a* of the guide portion 14, there is a distance D which is substantially constant along the track 20. In one exemplary embodiment, the distance D is about 200 mm to 350 mm, for example, about 250 mm.

The pins 28, 30 are at right angles on the guide portion 14. In the exemplary embodiment shown the pins 28, 30 extend through the recesses 22. In one exemplary embodiment, the pins 28, 30 can be supported at their free ends, for example, in order to absorb bending forces. In another exemplary embodiment, a chain can be used instead of a row of pins, for example, one chain for the row of pins 28 and one chain for the row of pins 30. In one exemplary embodiment the pins 28, 30 are made of chrome steel, have a diameter of about 10 mm to about 30 mm, for example about 15 mm, and a length of about 20 mm to about 50 mm, for example 30 mm. In one exemplary embodiment the pins 28, 30 are screwed into recesses 22. In another exemplary embodiment, the pins 28, 30 can be fastened in recesses 22, for example, by welding, soldering or adhesive bonding.

In the diagram shown in FIG. 6 an information generator 31 is visible on the guide element. The information generator 31 contains in one exemplary embodiment an RFID tag which stores the specified information which can be read by a reader 37 shown in FIG. 7, for example, an RFID reader. In this exemplary embodiment a plurality of such RFID tags are arranged along the guide element 32. The distance between the individual RFID tags can be selected flexibly depending on the desired accuracy. In one exemplary embodiment the distance is about 25 cm to about 40 cm, for example 32 cm).

Alternatively to these RFID tags, the information generator 31 can also be configured as a band or strip with a code located thereon, which can be read by a corresponding reader. The code can be provided continuously along the band or strip. However, it is also that the code has a plurality of discrete codes provided along the band or strip, for example barcodes or QR codes.

Depending on the configuration of the information generator 31, the information generator 31, for example, contains position information, speed information (for example, maximum speed at a certain point) and distance information (for example "straight travel" or "curve travel"). Further details relating to the implementation and use of the information generator 31 are described in connection with FIG. 18.

Figure 7:
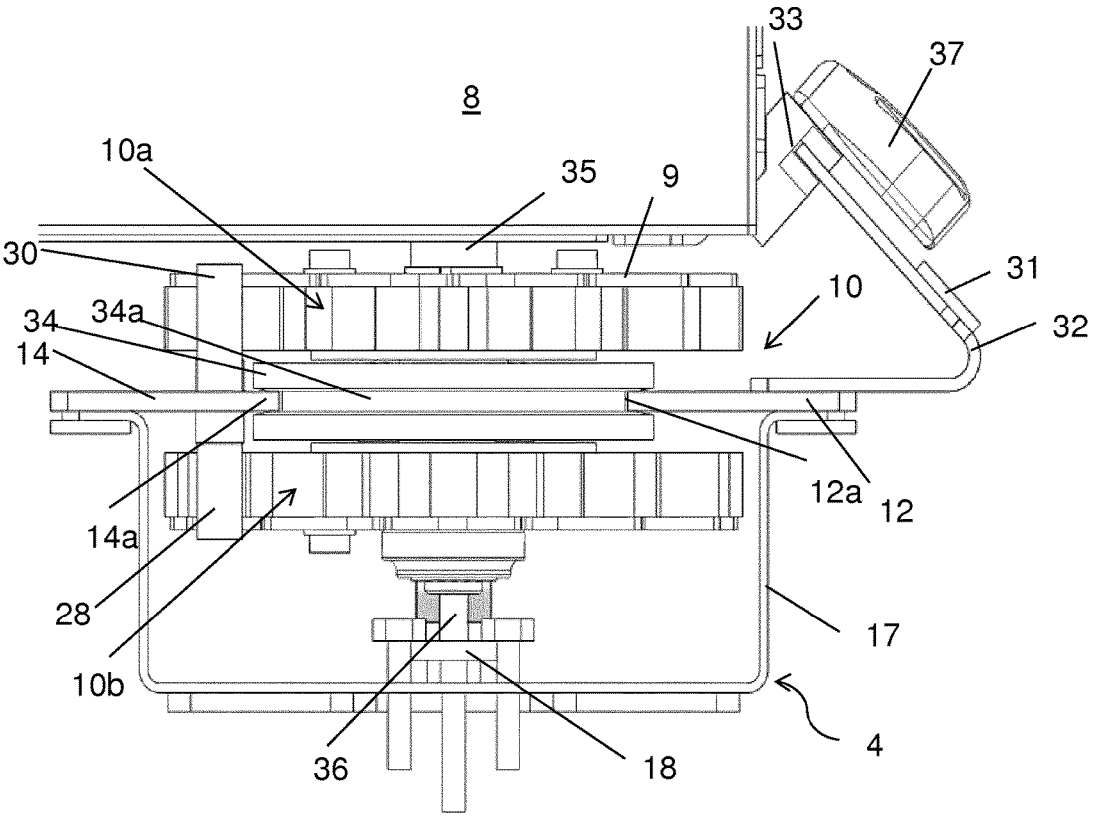
FIG. 7 shows a schematic illustration of a plan view of the drive unit in interaction with the guide system.

FIG. 7 shows a schematic illustration of a plan view of the drive system 8 in interaction with the guide system 4. Of the drive system 8, substantially the gear wheel system 10 is shown which acts on the pins 28, 30 and is guided by the guide parts 12, 14. Further components of the drive system 8 (e.g. motor, brake, control electronics) are shown in FIG. 7. Of the drive system 8 a contact element 36 is additionally shown which acts on the side of the gear wheel system 10 in contact with the conductor path 18. In one exemplary embodiment the contact element 36 is spring-mounted and presses against the conductor track 18 in order to compensate for any unevennesses of the conductor track 18 and thus remain continuously in contact with the conductor track 18. In another exemplary embodiment, the transmission of electrical energy can take place in a different manner, for example by means of induction. However, it is also possible to enable the transmission of electrical energy only to the vertical parts of the guide system 4 but not to the horizontal parts. During a horizontal travel, the energy supply can be made, for example, by an energy storage device 61 shown in FIG. 10.

In the exemplary embodiment shown the gear wheel system 10 consists of a pair of gear wheel disks 10*a*, 10*b* and a guide disk 34, which is disposed between the gear wheel disks 10*a*, 10*b*. The gear wheel disks 10*a*, 10*b* and the guide disk 34 are arranged on a common shaft 35. When viewed from the drive unit 8, the gear wheel disk 10*a* is an inner gear wheel disk and the gear wheel disk 10*b* is an outer gear wheel disk. Each gear wheel disk 10*a*, 10*b* has a fixed number of teeth which are spaced apart from one another by intermediate spaces and have a diameter of about 300 mm to about 500 mm, for example about 400 mm.

The dimensioning of a gear wheel and the parameters to be used are familiar to the person skilled in the art. The parameters comprise, for example tooth pitch (distance between two neighbouring teeth), number of teeth, modulus as a measure for the size of the teeth (quotient of tooth pitch and $\pi$), pitch circle (pitch circle), pitch circle diameter and outside diameter.

Figure 8:
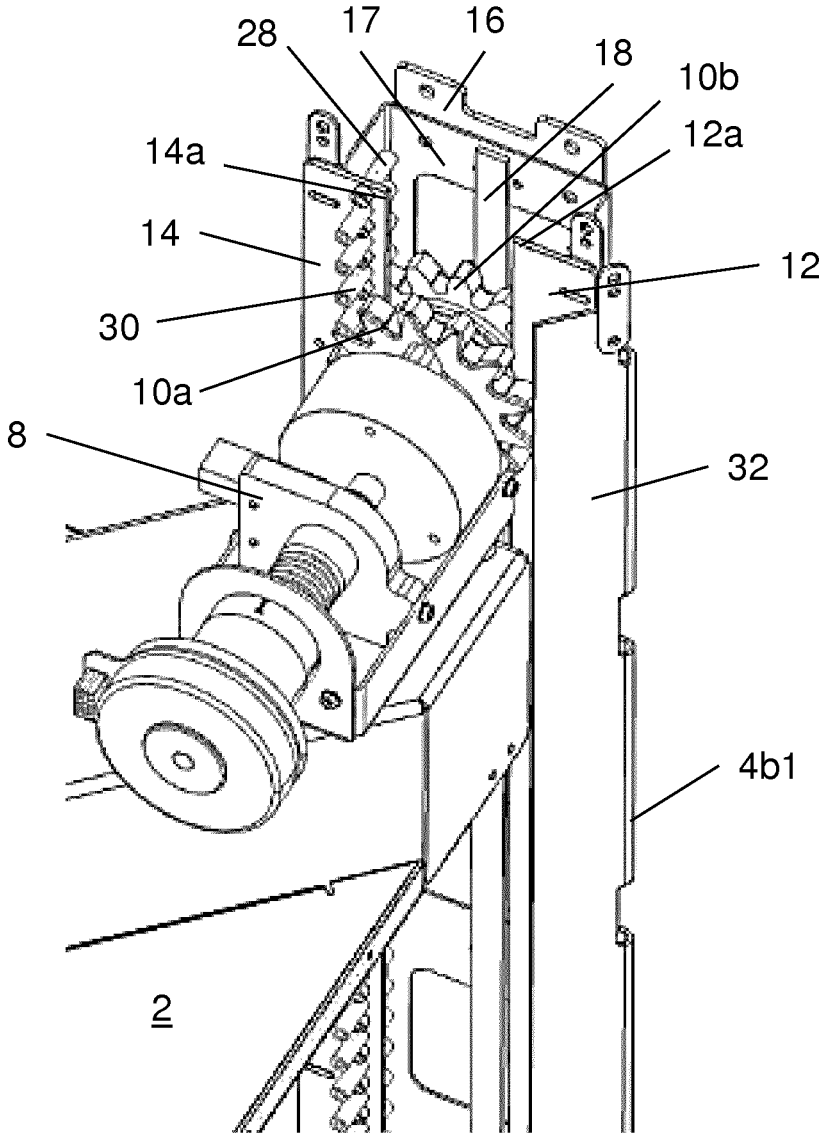
FIG. 8 shows a schematic illustration of a drive unit from FIG. 4 in interaction with the guide system in perspective view.
Figure 10:
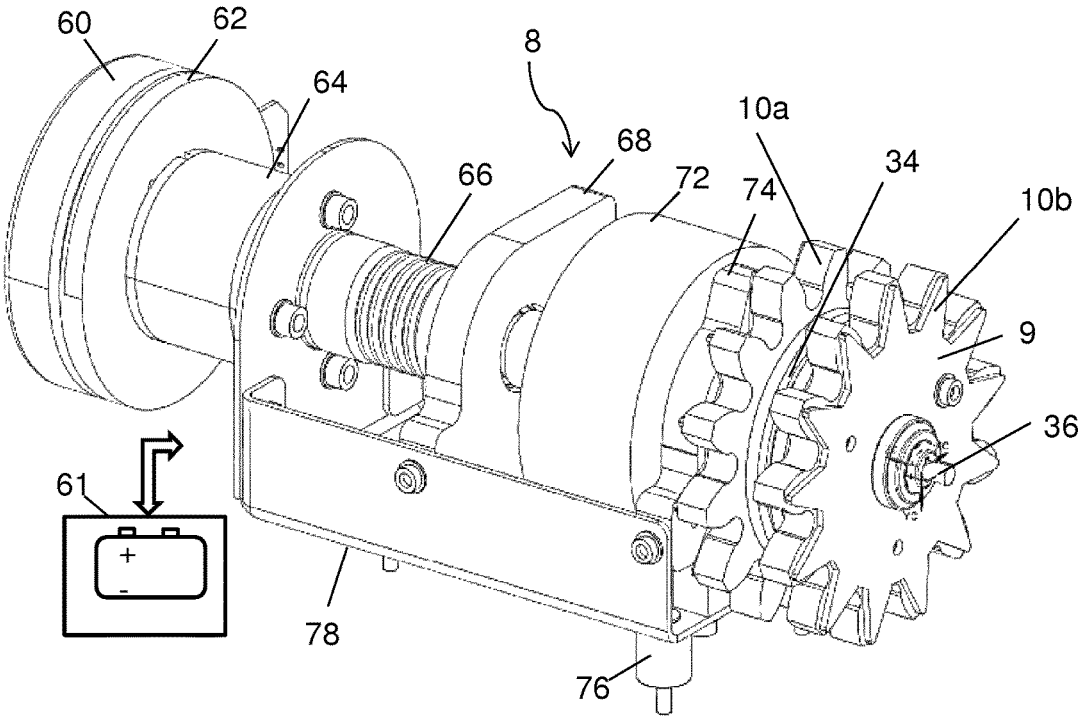
FIG. 10 shows the drive unit from FIG. 9 in perspective view.

In the exemplary embodiment shown the gear wheel disks 10*a*, 10*b* are arranged on the shaft 35 twisted with respect to one another by half a tooth spacing, as can be seen in FIG. 8 and FIG. 10. As explained above, the gear wheel disks 10*a*, 10*b* can also be arranged without such an offset. In one exemplary embodiment, the gear wheel disks 10*a*, 10*b* are made of a highly loadable plastic (for example, polyamide, preferably of polyamide 6 (PA6)). Inter alia, this avoids metal rubbing on metal, which causes abrasion and noise.

In one exemplary embodiment, the gear wheel disks 10*a*, 10*b* are made completely of highly loadable plastic (PA6). A toothed disk 9 of high-strength material, for example, steel can be fastened to one side surface of these gear wheels 10*a*, 10*b*, for example by screwing. These disks 9 have a high strength and serve to intercept the car 2 if—despite dimensioning with a safety factor—for example a plastic tooth should break out. In such a case the teeth of one disk 9 engage in the rack and pinion system.

The guide disk 34 is circular (see FIG. 10) and has a diameter of for example about 200 mm to about 400 mm, for example about 280 mm. Depending on the application, the guide disk 34 can also have a different diameter. The guide disk 34 has a guide groove 34*a* along its circumference. FIG. 7 shows that the guide edges 12*a*, 14*a* engage in the guide groove 34*a*. The guide groove 34*a* for example has a depth of about 10 mm to about 50 mm, for example, about 25 mm. Depending on the application, the guide groove 34*a* can also have a different depth.

In the diagram shown in FIG. 7, the information generator 31 and the reader 37 are also visible. The reader 37 is fastened to the car 2 and travels with this. The reader 37 is fastened to the car so that it can read information from the information generator 31 during travel. The reader 37 can, for example be fastened in the region of the car roof or on the drive unit 8. The information read by the reader 37 is then available for controlling the car 2.

In the exemplary embodiment, the reader 37 is an RFID reader with an antenna which reads out information stored on RFID tags. RFID tags are available commercially, for example, from microsensys GmbH, Germany. Such RFID tags can be written with desired information and have an adhesive side which enables the tags to be fastened to desired points along the guide element 32. The RFID technology, including the storage of information on RFID tags and its configuration and the reading of stored information is generally known; a detailed description of this technology is therefore not required at this point.

As mentioned in connection with FIG. 6, the information generator 31 can also comprise a plurality of discrete optical codes (for example, barcodes or QR codes). Each of these optical codes, for example, codes an identification number which is linked to information in a database (for example, position of the code or speed at the position of the code). Accordingly the reader 37 is a barcode or QR code reader. The technology relating to such optical codes, including the production of the code, the reading of the code and the linking a read code to stored information is generally known; a detailed description of this technology is therefore not required at this point.

In one exemplary embodiment, the system formed from the reader 37 and the information generator 31 is a redundant system. That is, the reader 37 and the information generator 31 are present in multiple numbers for safety reasons, for example two. In this exemplary embodiment, therefore two readers 37 and two information generators 31 are present; each reader 37 reads the assigned information generator 31. If the information generator 31 comprises a plurality of RFID tags, each position is assigned two RFID tags. If the information generator 31 is configured as a strip, two strips are provided, which for example are arranged parallel to one another and are read by two readers.

If when using RFID tags, the spacing of the RFID tags is selected so that only one RFID tag is the reading range of the antenna, gaps are obtained between the individual RFID tags in which for example no position identification can be made. In order to nevertheless obtain position information, in one exemplary embodiment, two readers 37 are arranged offset by half the RFID tag spacing. This ensures that at least one of the two readers 37 always has an RFID tag in the reading range. It can also be provided to attach two rows of RFID tags, for example on the guide element 32, one row at the back, the other at the front. The corresponding readers 37 are accordingly located one at the front and one at the rear on the car 2. However, the person skilled in the art identifies that the readers 37 and the information generators 31 (RFID tags) can also be arranged differently.

FIG. 8 shows a schematic illustration of the (rear) drive system 8 from FIG. 4 which engages in the rack and pinion system of the sub-section 4*b*1. It can be seen, for example, how the teeth of the gear wheel disk 10*a* engage in the intermediate spaces between the pins 30. The teeth of the gear wheel disk 10*b* engage in similar manner in the intermediate spaces between the pins 28. The guide edges 12*a*, 14*a* thereby engages in the guide groove 34*a*. It can also be seen in FIG. 8 that the gear wheel disks 10*a*, 10*b*, are twisted with respect to one another, i.e. the teeth of one gear wheel disk 10*a*, 10*b* are opposite the (tooth) intermediate spaces of the other gear wheel disk 10*a*, 10*b*. In one exemplary embodiment, the twisting is about 14°.

During rotation the gear wheel disks 10*a*, 10*b* rotate about the shaft 35, the teeth engage alternately in the intermediate spaces and apply forces to the pins 28, 30. Depending on the direction of rotation, the car 2 moves up or down on the vertical sub-sections and to the left or right on the horizontal sub-sections, in relation to FIG. 1. As a result of the twisting of the gear wheel disks 101, 10*b*, a quiet running of the gear wheel disks 10, 10 along the pins 28, 30 is achieved. By using a plurality of teeth, the individual teeth are less strongly loaded and the noise evolution is thus smaller.

Figure 9:
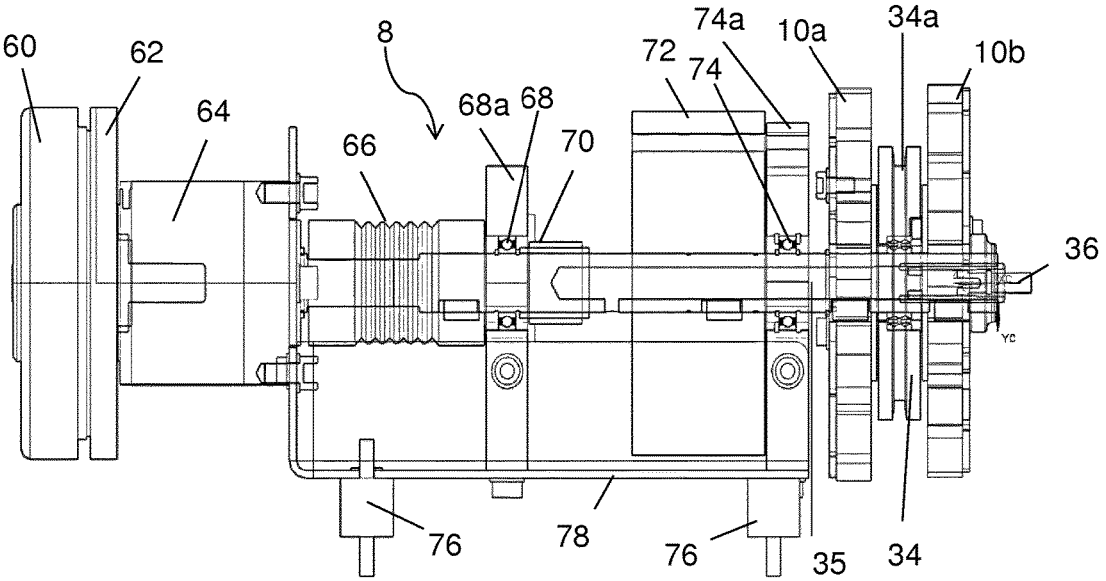
FIG. 9 shows a schematically depicted exemplary embodiment of a drive unit in plan view.

FIG. 9 and FIG. 10 show an exemplary embodiment of the drive unit 8, where FIG. 9 shows a side view and FIG. 10 shows a perspective view. In this exemplary embodiment, the drive unit 8 has a supporting frame 78 and damping elements 76 fastened to the supporting frame 78. In the mounted state the damping elements 76 are located between the car 2 and the supporting frame 78 of the drive unit 8. The damping elements 76 damp the relaying of vibrations from the drive unit 8 to the car 2 so that passengers, for example, are exposed to less noise. The damping elements 76 can be passive elements, for example, made of elastic material, e.g. rubber or metal spring elements. In addition, they can be configured as active elements in conjunction with the control electronics, e.g. based on one or more piezo-elements. The dimensioning of the damping elements 76, for example with regard to the desired damping and the predicted frequency range, corresponds to the action of the person skilled in the art.

The supporting frame 78 carries the drive unit 8; some components of the drive unit 8 are therefore fastened to the supporting frame 78. In the configuration shown the supporting frame 78 has an L-shaped cross-section with one long leg and one short leg. Bearings 68, 74 which project substantially at right angles from the long leg are fastened for example on the long leg (in FIG. 9 this is horizontal). The bearing 74 is in one configuration a fixed bearing (74) which prevents all translational movements of a mounted body and which is arranged in a fixed bearing support 74*a*. The bearing 68 is a floating bearing (68) which prevents a radial translational movement but allows the others. The floating bearing 68 is arranged in a floating bearing support 68*a*. The shaft 35 is mounted in the bearings 68, 74.

A transmission 64 is fastened to the short leg of the supporting frame 78, for example by means of one or more screw connections. On a side of the transmission 64 facing away from the screw connections, the transmission 64 is connected to a unit comprising an electric motor 60 and an encoder 62. Such a unit and the transmission 64 are available, for example from Maxon (Switzerland).

On the side of the screw connections, an output shaft of the transmission 64 is connected to a coupling 66 which is connected to the shaft 35 mounted on the floating bearing 68. In one exemplary embodiment the coupling 66 is a metal bellows coupling (also called corrugated tube coupling). Such a coupling element (coupling) enables a torsionally rigid but somewhat axially and angularly offset connection of two shafts (for example, transmission shaft and shaft 35).

A sliding contact 70 is provided on the shaft 35, which rotates with the shaft 35 and is connected to the contact element 36 in an electrically conducting manner. The electrical energy can be tapped at this sliding contact 70 and supplied to the control unit (see control unit 90 in FIG. 18) of the car 2. The motor 60 is connected to this control unit and is actuated by this.

A brake 72 which acts on the shaft 35 is provided between the floating bearing 68 and in the fixed bearing 74. The brake 72 is thus arranged close to the gear wheel system 10. If a rupture of the shaft 35 should unexpectedly occur, for example, between the bearing 68 and the motor 90, the brake 72 can nevertheless act on the shaft 35 and reliably brake the car 2. This contributes to the operating safety of the lift system 1. In one exemplary embodiment the brake 72 is an electromechanical spring-loaded brake. A spring-loaded brake, for example, has a brake disk with two friction surfaces. In the de-energized state a braking torque is generated by frictional locking by a plurality of compression springs. The brake is released electromechanically. In order to ventilate the brake, the coil of a magnetic part is excited by DC voltage. The resulting magnetic force attracts an armature disk against the spring force onto the magnetic part. The brake disk which is coupled to the axis 35 is thus relieved of the spring force and can rotate freely.

The brake 72 serves as a safety brake in order to prevent an uncontrolled downwards movement of the car 2. The brake 72 applies a direct force to the gear wheel system 10 for this purpose. The brake 72 is actuated by a safety unit which for example detects an excess speed and initiates braking. The safety brake is preferably designed to be "fail-safe", i.e. the brake 72 is active as long as it is not expressly deactivated. The safety unit electronically deactivates the brake 72. The availability of the brake 72 is additionally increased by redundancy since two brakes 72 are provided per car 2.

In one exemplary embodiment a separate retainer can be provided on the car 2. Retainers are, for example, known from traction lifts and can be triggered electronically or mechanically. An excess speed can, for example, be triggered electronically by means of a sensor or mechanically by means of a centrifugal force controller. The retainer is arranged so that it acts on the guide system 4.

FIG. 10 additionally shows an electrical energy storage device 61 which is arranged on the car 2, for example on the car roof and is coupled to electrical devices of the car 2, including car lighting, alarm and emergency devices and the drive unit 8. The energy storage unit 61 contains, for example, one or more batteries, rechargeable batteries, supercapacitors or a combination of such energy storage devices. In one exemplary embodiment the energy storage device 61 is re-chargeable, for example via the conductor track 18 by the power supply of the lift system 1 or if the motor 60 can also be operated as a generator, by the motor 60 for example during braking or travelling downwards. In the last-mentioned case, any excess energy can be fed via the conductor track 18 into the power supply.

The energy storage device 61 provided locally on the car 2 in the intermediate circuit serves to maintain specified functions of the car 2 with the stored energy at least for a specified period of time in the event of any failure of the power supply. As a result, the car 2 can, for example, approach the nearest floor, possibly at a reduced speed where the passengers can then alight. During the approach to this floor, the car 2 remains illuminated for the safety of the passengers, albeit possibly only with emergency lighting. The energy storage device 61 additionally provides energy for the emergency device and the electromechanical brake 72. It is thereby ensured that even in the event of a power failure, the car 2 can be moved in a controlled manner under all circumstances and come safely to a standstill.

Figure 12:
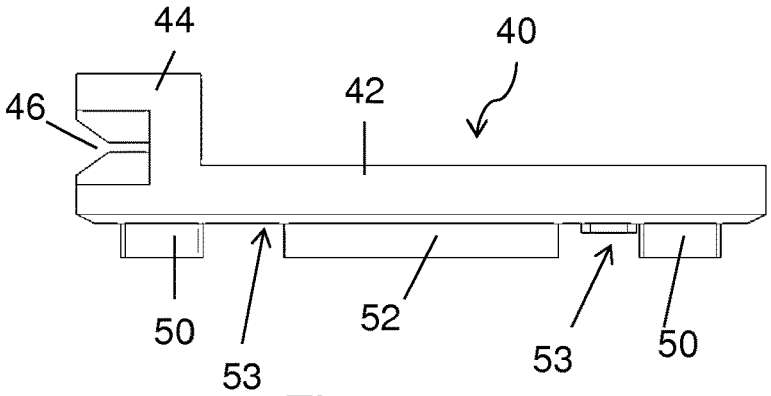
FIG. 12 shows a schematic plan view of the guide shoe from FIG. 11.
Figure 11:
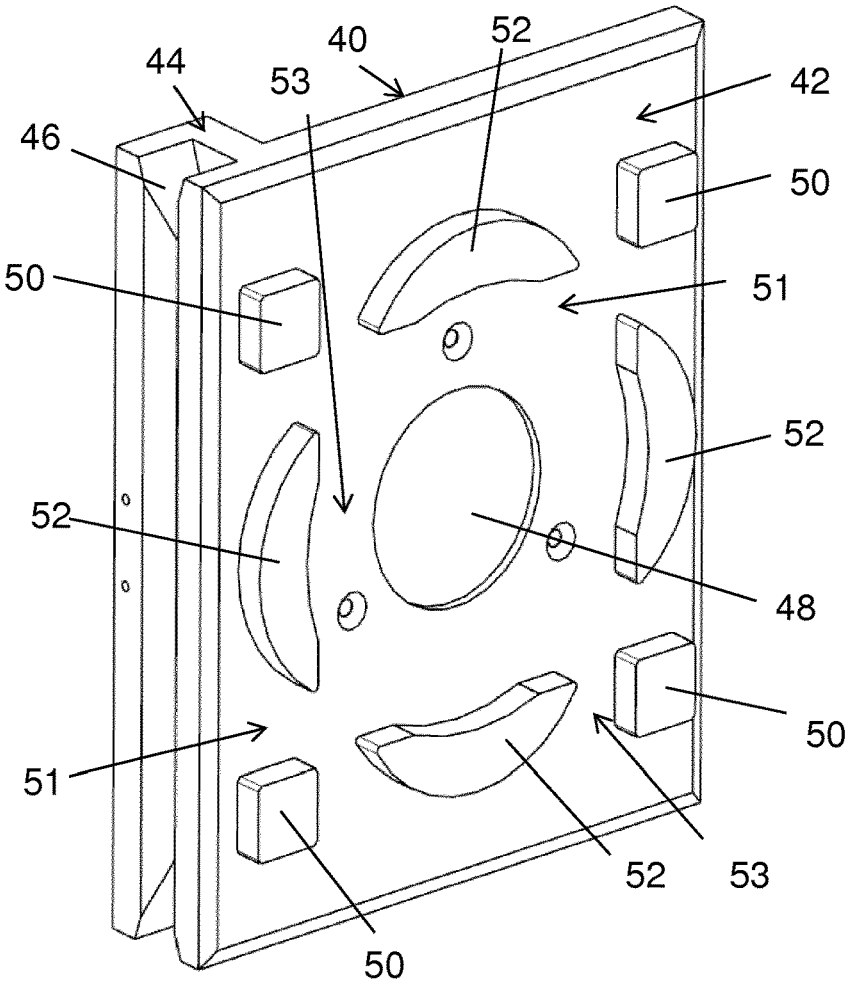
FIG. 11 shows a schematic illustration of an exemplary embodiment of a guide shoe for an exemplary embodiment of a second guide system.

FIG. 11-FIG. 15 shows another exemplary embodiment of a guide system 4. FIG. 11 shows a schematic illustration of an exemplary embodiment of a guide shoe 40 for this guide system and FIG. 12 shows a plan view of the guide shoe 40. The guide shoe 40 has a rectangular front plate 42 with a front side and a rear side, where the rear side points towards the drive unit 8 and the front side points toward the gear wheel system 10. A side portion 44 of the guide shoe 40 points from the rear side of the front plate 42 also in the direction of the drive unit 8. The side portion 44 has a guide groove 46.

Figure 15:
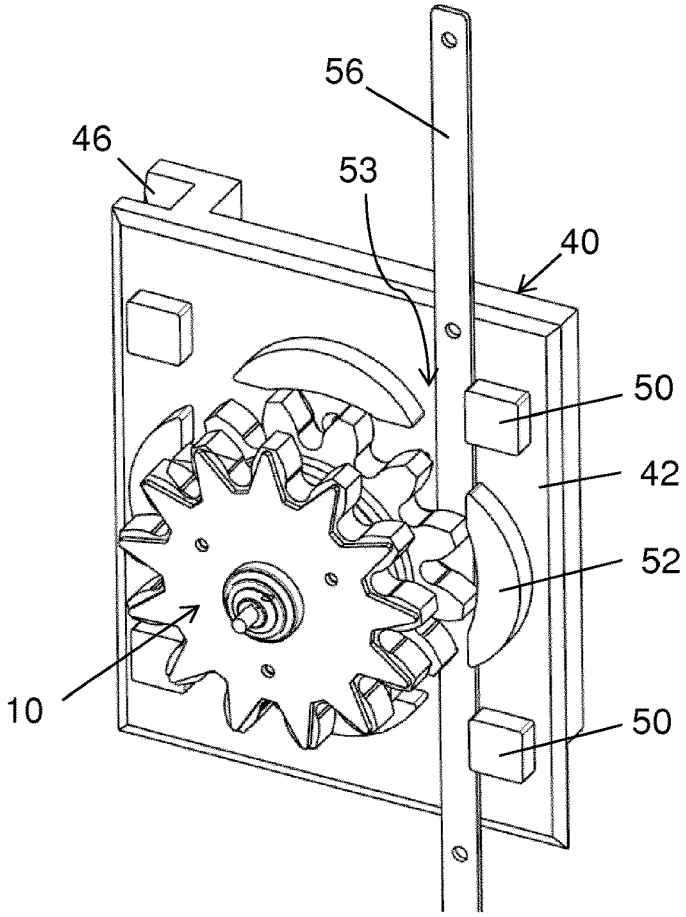
FIG. 15 shows an illustration of the guide shoe with a guide profile arranged thereon and a gear wheel system of the drive unit.

On the front side the guide shoe 40 has parts 50, 52 which are arranged inside a, for example imaginary rectangle (or square) inside the rectangular front plate 42. The (four) parts 50 are in this case arranged in the area of the corners of the imaginary rectangle and the (four) parts 52 are arranged in the area of the side lines of this rectangle, in each case between the parts 50. The parts 50 have a rectangular structure and the parts 52 have a ring-segment-shaped structure. As a result of this arrangement of the parts 50, 52, tracks 51, 53 are obtained in a plane parallel to the plane of the front side; two tracks 51 extend perpendicular to the guide groove 46 and two tracks 53 extend parallel to the guide groove 46. In FIG. 12 the guide groove 46 and the tracks 53 extend perpendicular to the plane of the drawing. In operation, a guide profile 56 shown in FIG. 13 moves in one of these tracks 51, 53 whilst the guide shoe 40 inter alia guided by the parts 50, 52 moves along the guide profile 56, as also shown in FIG. 15.

Figure 16:
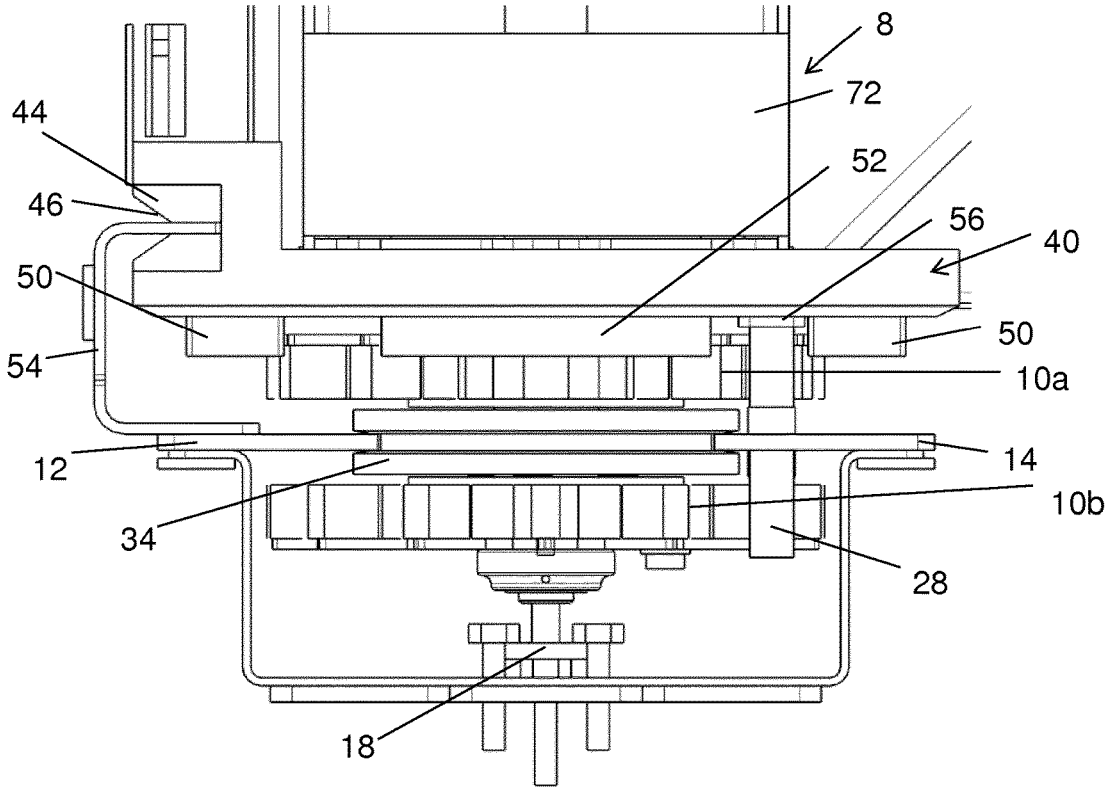
FIG. 16 shows a schematic illustration of a plan view of the drive unit in interaction with the second guide system.

The guide shoe 40 additionally has an opening 48 for receiving the shaft 35 of the drive unit 8. In the installed state the guide shoe 40 is fastened on the fixed bearing support 74*a*, as shown in FIG. 16. The guide shoe 40 consists of high-strength material, for example plastic, in particular PA6. In one exemplary embodiment the guide shoe 40 is made from a plastic part of corresponding size which has been machined by a cutting method, e.g. milling.

Figure 13:
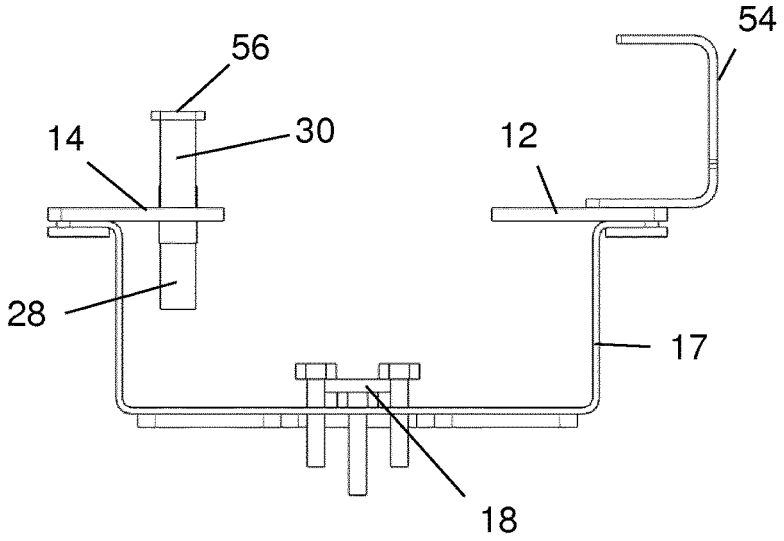
FIG. 13 shows a cross-section through the second guide system.

FIG. 13 shows a cross-section through a schematically depicted exemplary embodiment of the second guide system 4. Similarly as in FIG. 5, FIG. 13 shows a cross-section through the second guide system 4 whose basic structure is the same as that of the exemplary embodiment shown in FIG. 5. At this point, only the differences between these exemplary embodiments are discussed. Instead of a V-shaped guide element 32, the exemplary embodiment shown in FIG. 13 has a U-shaped guide element 54 which engages in the guide groove 46 of the guide shoe 40 during operation. The guide element 54 is also fastened to the guide part 12. The already-mentioned guide profile 56 extends in FIG. 13 over the ends of the pins 30 and is fastened to the pins 30. In one exemplary embodiment the guide profile 56 is screwed to the pins 30. Alternatively the guide profile 56 can be welded or soldered to the pins 30.

Figure 14:
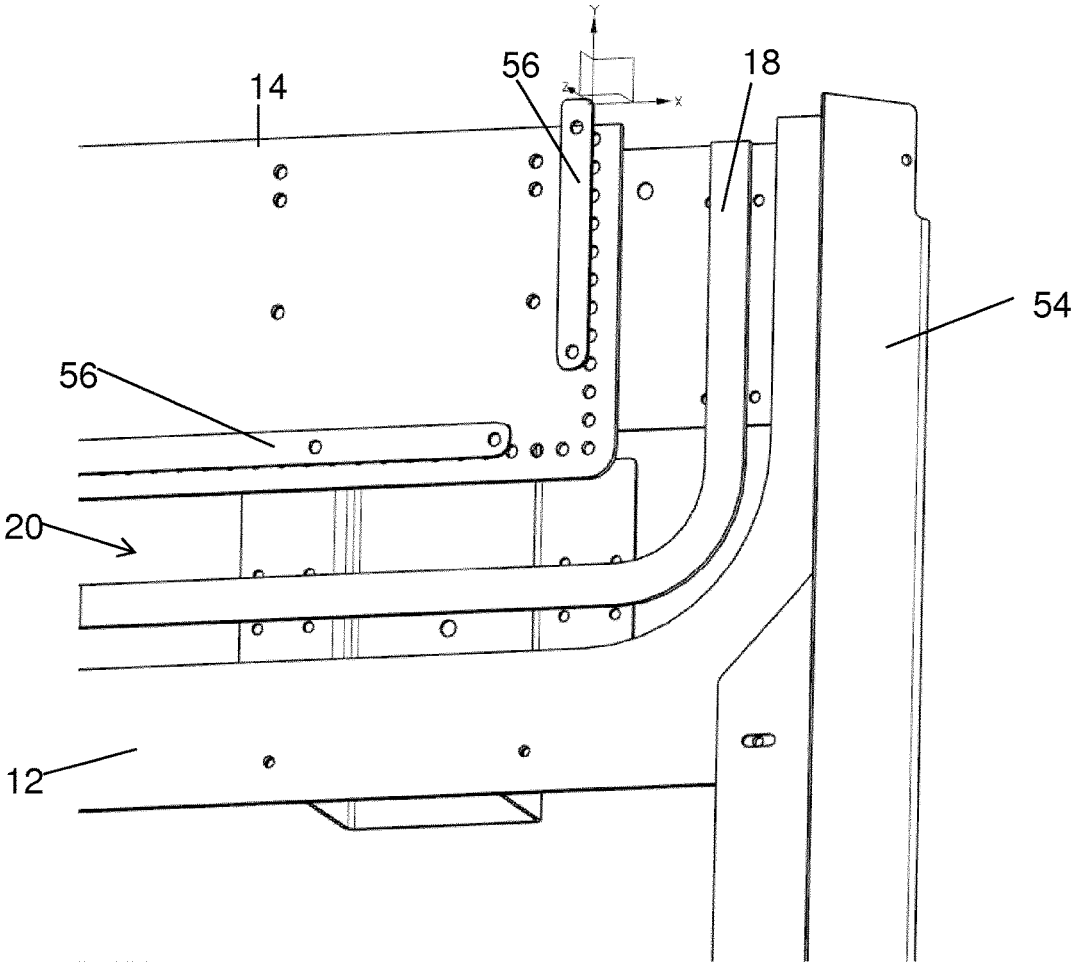
FIG. 14 shows schematically depicted lower region of the second guide system.

FIG. 14 shows a schematically depicted exemplary embodiment of a part of a lower area of the second guide system 4. Similarly to FIG. 3, FIG. 14 shows a schematic exemplary embodiment of a horizontal sub-section 4*a*3 of the second guide system. The fundamental structure corresponds to the exemplary embodiment shown in FIG. 3. At this point therefore only the differences are discussed. A horizontal sub-section from the upper area of the lift system is configured accordingly; this also applies to the corresponding rear-side sub-sections.

In the exemplary embodiment shown in FIG. 14, the guide system 4 comprises the guide element 54, a vertical guide profile 56 and a horizontal guide profile 56. In the area of the transition from the vertical into the horizontal, i.e. in a corner of the guide portion 14, the guide profiles 56 are spaced apart from one another. This allows a change in direction (travel around curves) because one or more parts 50 can temporarily move out from the guide system during travel around curves. The part 52 is supported on the guide portion 56 during travel around curves. The guide rail 54 extends beyond the guide portion 12 whereby it is possible to guide the car 2 (not the drive unit 8) with the aid of the guide portion 12.

Figure 17:
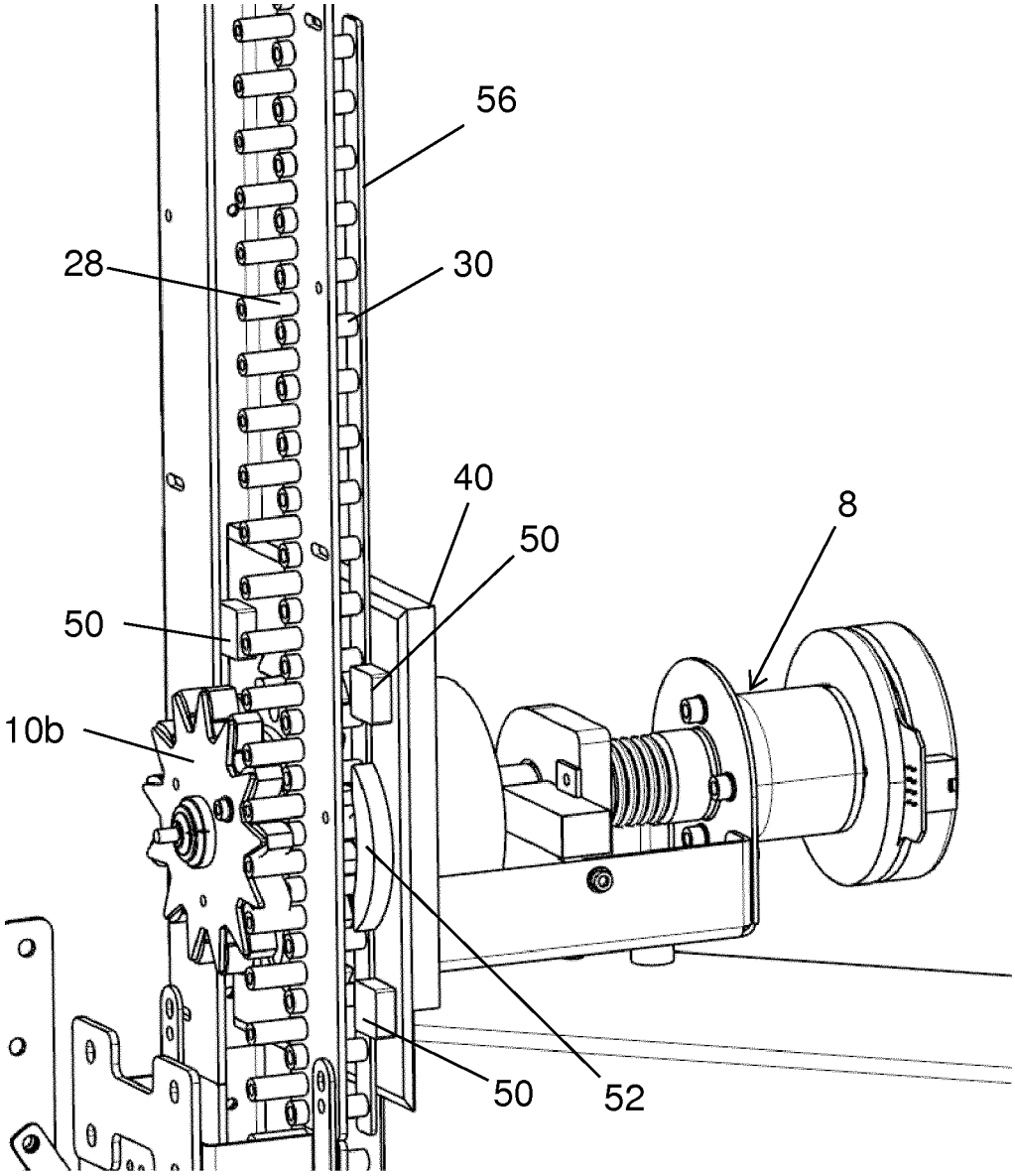
FIG. 17 shows a schematic illustration of a drive unit in interaction with the second guide system in perspective view.

FIG. 15 shows in perspective view an illustration of the guide shoe 40 with a guide profile 56 arranged thereon and a gear wheel system 10 of the drive unit 8. FIG. 17 shows in perspective view a schematic illustration of a drive unit 8 in interaction with the pins 28, 30, where the guidance is shown for example by the guide shoe 40. With reference to FIG. 15 and FIG. 17, the guide profile 56 extends in the track 53 of the guide shoe 40, where the guide profile 56 is located between the front plate 42 and the gear wheel system 10. The guide profile 56 thereby contacts the parts 50, 52 on one side and is guided by these within the track 53 during operation. The guide shoe 40 serves inter alia to absorb torques; for this the guide shoe 40 is fastened on a fixed bearing support 74*a*. A torque is a physical quantity; if a force acts at right angles to a lever arm, the magnitude of the torque is obtained from the length of the lever arm multiplied by the magnitude of the force. The lever arm here is the distance from the tooth engagement on the gear wheel 10*a*, 10*b* to the shaft 35 and the force is the sum of the force produced by the drive unit 8 and weight force of the car 2 plus loading in the car 2. The torques are received directly where they are produced by the guide formed from guide element 54, guide groove 46 and parts 50, namely where the gear wheel 10*a*, 10*b* engages in the rack and pinion system (pins 28, 30).

During operation, in one exemplary embodiment the guide element 54 is additionally located in the guide groove 46, whereby a sliding guidance of the guide shoe 40 along the guide system 4 is achieved. Depending on the configuration of the system and desired degree of guidance, the combination of guide element 54 and guide groove 46 can also be omitted. It is also possible to replace the sliding guidance by means of guide groove 46 and guide element 54 by a (running) roller guidance. In this case, usually a plurality of rollers or wheels of a running body (here: car 2) run along a guide rail.

FIG. 16 shows a schematic illustration of a plan view of the drive unit 8 in interaction with the second guide system. Of the drive system 8 again substantially the gear wheel system 10 is shown which acts on the pins 28, 30 and is guided by the guide portions 12, 14. Further components of the drive system 8 (e.g. motor, brake) are not shown in FIG. 16. The gear wheel system 10 is configured as described above in connection with FIG. 4 and functions as described there. The guide shoe 40 is arranged between the gear wheel disk 10*a* and the brake 72.

FIG. 16 additionally shows that the guide element 54 engages in the guide groove 46 of the guide shoe 40 and the guide profile 56 rests on part 50 of the guide shoe 40. As mentioned above, the guide profile 56 in this case also rests on the part 52 and a further part 50. In this case, it can be seen that the (or each) drive unit 8 and therefore also the car 2 are guided within narrow limits along the guide system 4; the guide edges 12*a*, 14*a* engage in the guide groove 34*a* of the guide disk 34, the guide element 54 engages in the guide groove 46 and the guide profile 56 guides the parts 50, 52 of the guide shoe 40.

The arrangement (front left and rear right) of the drive units 8 on the car 2 described with reference to the figures, for example, FIG. 1, FIG. 2 and FIG. 4 should be understood as exemplary. The person skilled in the art identifies that the drive units 8 can in principle also be arranged differently, for front right and rear left, in each case relative to the opening 6. The guide system 4 should be adapted accordingly. In addition, each drive unit 8 can also be arranged underneath the car 2.

The lift system 1 described in various exemplary embodiments in FIGS. 1-17 can be operated in various ways. Each car 2 has its own drive, for example, two drive units 8, with the result that they can be moved autonomously independently of other cars 2. However this movability is subject to limits since a collision with a neighbouring car 2 must be avoided. Various aspects for controlling the cars 2 are described in connection with FIG. 18.

Figure 18:
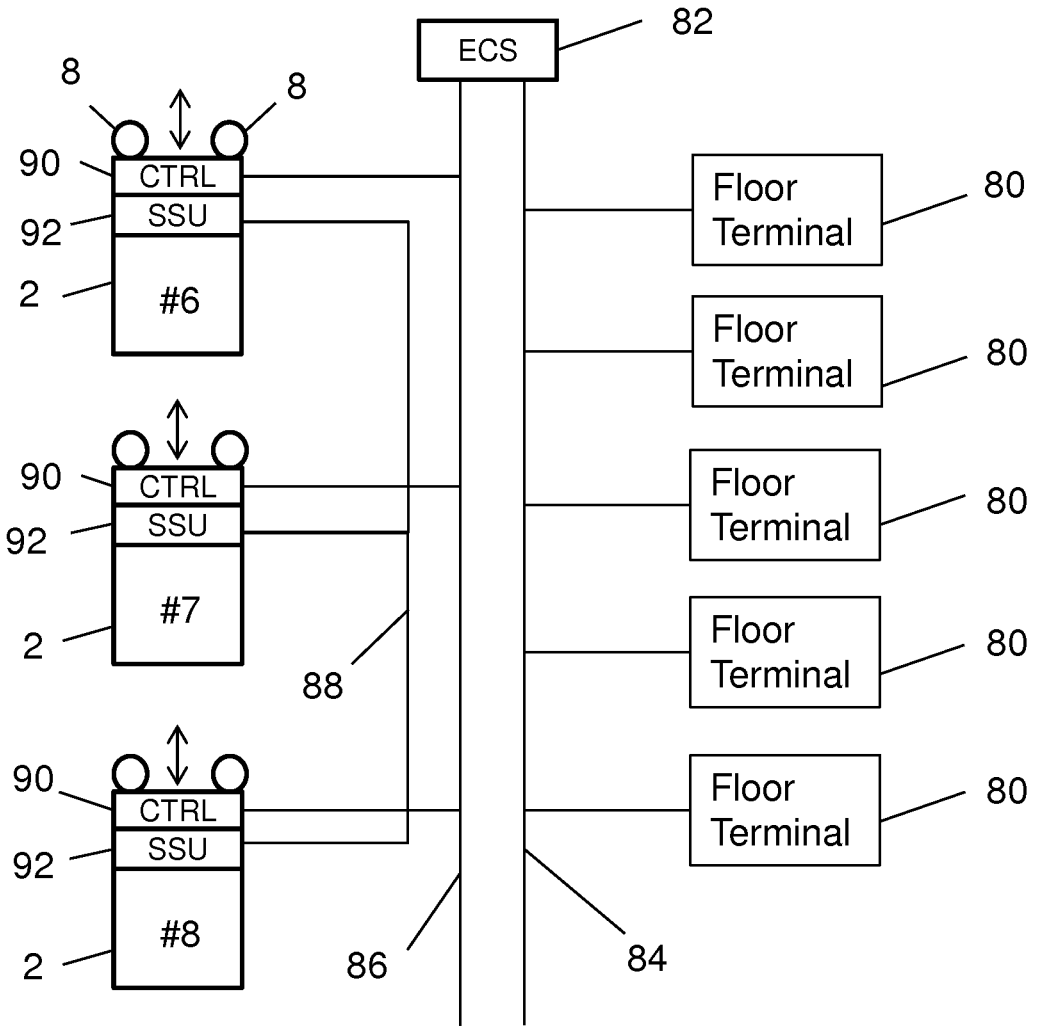
FIG. 18 shows a schematic illustration of the lift system with a central control unit and a number of floor terminals.

FIG. 18 shows a schematic illustration of a lift system with a central control unit (ECS) 82 and a number of floor terminals 80. The floor terminals 80 can be arranged on different floors. A communication network 84 connects the floor terminals 80 with the control unit 82. It is also indicated in FIG. 18 that each car 2 has a control unit (CTRL) 90 and a system monitoring device (SSU) 92. A communication network 86 connects the control units 90 of the cars 2 with the control unit 82 and a communication network 88 connects the system monitoring devices 92 of the cars 2 to one another. For better clarity FIG. 18 only shows three cars 2 (characterized as #6, #7, #8) which can travel up and down (indicated by double arrows); the guide system 4 is not shown here. However, the illustration of the lift system in FIG. 18 should be understood so that in principle it corresponds to the lift system 1 shown in FIG. 1.

The communication networks 84, 86, 88 are shown as separate communication networks in FIG. 18. However, the person skilled in the art also identifies that these communication networks 84, 86, 88 can also be combined in a common communication network so that communication takes place via one communication network. The individual floor terminals 80, control units 90, system monitoring devices 92 are connected to this common communication network and can, for example, communicate with the central control unit 82. In one exemplary embodiment, the communication networks 84, 86, 88 or the common communication network are implemented as radio networks. Suitable radio networks for this are known, for example a WLAN network or networks based on ZigBee or Bluetooth.

Compared with a wired communication network, a radio network has the advantage that it can be installed relatively flexibly without major expenditure. This is primarily an advantage when communication units, for example like the car 2 here can move in a lift system. The floor terminals 80 are usually fixedly installed so that a wired communication network can be provided for communication between the central control unit 82 and the floor terminals 80. Such a communication network can be implemented in a bus structure.

Each floor terminal 80 has an input device to enable a person to input a desire to travel. In one exemplary embodiment the person inputs the desired destination floor on the floor, that is a destination call is produced which are assigned a starting floor and a destination floor. The input device can be differently configured for this, for example with a keypad, a touchscreen and/or a reading device for an optical barcode (e.g. barcode or QR code) or for communication with an RFID transponder on a carrier material (for example, in the form of a credit card).

The destination call thus generated is transmitted to the central control unit 82 which evaluates this. For this evaluation in one exemplary embodiment an allocation algorithm known from destination call controllers is used. Such an allocation algorithm is known, for example from WO0172621A1. The allocation algorithm allocates to the destination call (i.e. a task) that car 2 which best meets the criteria specified for this destination call, for example with regard to waiting time and travel time.

With regard to the allocation of tasks, the person skilled in the art identifies that the allocation of tasks to the cars 2 is not necessarily made at the time of input of a destination call but in any case only subsequently, possibly shortly before the execution of the task. According to the configuration of the lift system, an allocation to a car 2 can also be revised or cancelled.

When a car 2 is allocated, this is notified to the passenger on the starting floor. In one exemplary embodiment the central control unit 82 notifies the allocated car 2 to the floor terminal 80. Alternatively or additionally, the allocated car 2 can be displayed on a floor display. The floor display can, for example, display the destination floor, the allocated car 2 and the expected arrival time of the allocated car 2 on the starting floor. This has the advantage that the person knows when "his" car 2 is arriving. If several persons wish to travel from this starting floor, it can arise that the persons are unsure which car 2 they must get in in order to arrive at their desired destination floor. In order to avoid this possible uncertainty, the floor display for a car 2 ready to enter can display which destination floor or floors are served by this car 2. In one exemplary embodiment, this can alternatively or additionally be accomplished by a loudspeaker communication.

The central control unit 82 additionally actuates the selected car 2. A control command used for this for example contains information about the direction of travel (up/down) and/or starting/destination floor (from/to). From there on the car 2 substantially autonomously executes the control command. The drive unit 8 of the car 2 responds to the control command for example by releasing the brake 72 and activating the motor 60 which then turns the shaft 35 according to a specified drive profile. The drive profile, for example, specifies the direction of rotation of the shaft 35, the starting acceleration and the target speed. The starting acceleration and the target speed can be related to the shaft 35 (e.g. rotational speed of the shaft 35) or the car 2.

In one exemplary embodiment the car 2 determines its position during travel by means of the information generator 31 or the information generators 31. If the information generator 31 contains further information (e.g. maximum speed) in addition to the position, the control unit 90 and the system monitoring device 92 of the car 2 also process this information. The system monitoring device 92 communicates status parameters of the car 2, for example, position, distance from a neighbouring car 2, direction of travel and speed, via the communication network 88 to other cars 2 (or the system monitoring devices thereof 92) or to the central control unit 82. In one exemplary embodiment a car 2 only communicates with directly neighbouring cars 2; in FIG. 18 the car #7 only communicates with cars #6 and #8. As a result, each car 2 is informed about the status parameters of its neighbouring cars 2. The cars 2 thus observe, for example, specified safety distances and/or adapt their speeds. From the point of view of a passenger, it is desirable in order to avoid for example feelings of anxiety or panic, if there is no stopping outside a stopping floor without the door opening during a trip. In one exemplary embodiment the cars 2 can be fitted with display units which display to the passengers the status, position information and/or other travel information. Car doors can also be provided which are completely or partially transparent so that passengers can identify, for example when the car 2 is on a floor and when it is not.

When the car 2 approaches the destination floor the drive unit 8 reduces the rotational speed of the shaft 35 so that the gear wheel system 10 rotates more slowly and the car 2 is braked to a standstill at the destination floor. In normal operation the car 2 is braked by reducing the rotation of the gear wheel system 10 on which the rack and pinion system acts. If the car 2 stops, in one exemplary embodiment the brake 72 is activated.

During operation of the cars 2, it is always ensured that collisions are avoided and the cars 2 can be safely brought to a standstill under all circumstances. In order to enable this, each car 2 (or its control unit 90 and/or system monitoring device 92) performs analyses and calculations continuously (primarily during execution of a control command but also beforehand). For example, the car 2 continuously calculates by means of its own status parameters a braking distance which would be required at the calculation time to come to a standstill.

Various actions are specified to execute the control command, for example, an acceleration of the car 2 to a specific speed. Based on these actions the car 2 calculates a projected situation for the next time. To this end status parameters of the leading or trailing car are evaluated and a guaranteed free distance for the car 2 is determined; this corresponds as it were to a "worst case". If the free distance at the next time point is greater than the braking distance, the planned action can be executed. If however at the next time point, the free distance is shorter than the braking distance, braking is initiated or arrival is prevented.

At least one of the control processes described here can be executed by a computer or a computer-assisted device which executes or instigates one or several process steps. The computer or the computer-assisted device contains reading instructions for executing the process steps of one or more cuter-readable storage media. These storage media can for example contain volatile memory components (e.g. DRAM or SRAM), non-volatile memory components (e.g. hard disks, optical disks, Flash RAM or ROM) or a combination thereof.

What is claimed is:

1. A lift system comprising: a guide rail system, a car and a drive unit arranged on the car, wherein the guide rail system forms a closed track along which the car can be moved between floors when in operation; wherein the drive unit has a motor, a gear wheel system coupled to the motor by means of a shaft and a guide disk, wherein the motor drives the gear wheel system when in operation; and wherein the guide rail system has a pinion system and guide edges spaced apart from one another, which cooperate with the guide disk, wherein the gear wheel system acts on the pinion system when in operation in order to move the car along the track in a guided manner, wherein the guide rail system has a guide element which extends along a vertical subsection of the guide rail system and wherein a receptacle coupled to the car is provided in which the guide element engages, wherein the receptacle is provided on a guide shoe configured as a guide groove, wherein the guide shoe is arranged non-rotatably about the shaft.

2. The lift system according to claim 1, wherein the pinion system comprises a plurality of first pins arranged in a first row and spaced apart by intermediate spaces and a plurality of second pins arranged in a second row and spaced apart by intermediate spaces, wherein the first row and the second row are arranged along a common line on a first guide portion of the guide system.

3. The lift system according to claim 2, wherein the first pins on a first side of the first guide portion point in a first direction and the second pins on a second side of the first guide portion point in a second direction, wherein the first direction is opposite the second direction.

4. The lift system according to claim 3, wherein the gear wheel disks are twisted with respect to one another.

5. The lift system according to claim 4, wherein the gear wheel disks are twisted with respect to one another by half a tooth pitch.

6. The lift system according to claim 1, wherein the gear wheel system has a first gear wheel disk and a second gear wheel disk spaced apart from this, which are arranged on the shaft, wherein the guide disk is arranged between the first and the second gear wheel disk on the shaft.

7. The lift system according to claim 1, wherein the guide disk has a guide groove in which the guide edges engage.

8. The lift system according to claim 1, wherein a conductor track is provided on the guide rail system with which the drive unit is in electrical contact in order to supply the drive unit with electrical energy.

9. The lift system according to claim 1, wherein the receptacle is provided on the car configured as a guide groove.

10. The lift system according to claim 1, wherein on one side facing the gear wheel system and the pinion system, the guide shoe has parts which define travel paths and wherein a guide profile which can be guided in one of the travel paths is affixed on the pinion system.

11. A lift system comprising: a guide rail system, a car and a drive unit arranged on the car, wherein the guide rail system forms a closed track along which the car can be moved between floors when in operation; wherein the drive unit has a motor, a gear wheel system coupled to the motor by means of a shaft and a guide disk, wherein the motor drives the gear wheel system when in operation; and wherein the guide rail system has a pinion system and guide edges spaced apart from one another, which cooperate with the guide disk, wherein the gear wheel system acts on the pinion system when in operation in order to move the car along the track in a guided manner, wherein a plurality of cars are provided, which can be moved independently of one another on the closed track, wherein each car has a local control unit and wherein a central control unit is provided which is communicatively connected to the local control units and a fixed number of floor terminals, wherein the communicative connection between the central control unit and the local control units is made via a radio network.

* * * * *